United States Patent [19]

Musannif et al.

[11] 3,980,341

[45] Sept. 14, 1976

[54] BREAKING UP OF CONCRETE SURFACE LAYERS OR THE LIKE

[75] Inventors: Ahmed Asim Bilgin Musannif, Dunstable; Joseph Folkard Eden, Shenley, both of England

[73] Assignee: National Research Development Corporation, London, England

[22] Filed: Mar. 14, 1974

[21] Appl. No.: 451,292

[52] U.S. Cl. ..... 299/36; 125/23 R; 225/103; 241/1

[51] Int. Cl.[2] ..... E01C 23/12

[58] Field of Search ..... 299/36, 37, 70; 241/1; 125/23 R, 1; 225/103, 104, 105; 144/193 R, 193 A

[56] References Cited

UNITED STATES PATENTS

| | | | |
|---|---|---|---|
| 968,422 | 8/1910 | Rosenholz | 299/37 |
| 2,798,475 | 7/1957 | Hoose | 125/23 R |
| 2,878,002 | 3/1959 | Haley | 299/36 |
| 3,026,865 | 3/1962 | Sunada | 125/23 R |
| 3,456,885 | 7/1969 | Bodine | 241/1 |
| 3,719,314 | 3/1973 | Cox | 225/104 X |

FOREIGN PATENTS OR APPLICATIONS

| | | | |
|---|---|---|---|
| 2,340,188 | 8/1973 | Germany | 299/36 |
| 344,994 | 3/1931 | United Kingdom | 299/36 |

*Primary Examiner*—Ernest R. Purser
*Assistant Examiner*—William F. Pate, III
*Attorney, Agent, or Firm*—Cushman, Darby & Cushman

[57] ABSTRACT

An apparatus for breaking concrete surface layers, masonry walls, or like planar constructions, includes two foot members for engaging one surface of the construction at positions spaced apart from one another along a free edge of the construction, and a third member disposed so as to lie on the other side of the construction at a position substantially equally spaced from each of the foot members. An expansion device cuts between a body portion of the apparatus and the free end of the third member and operates to bring the three members into or out of gripping relationship with the construction with the third member furthest from the free edge of the construction. The first member is then moved relatively to the foot members, e.g. by tilting the apparatus, and this exerts a breaking moment on the constructions. Free standing and excavator-mounted versions of the apparatus are described in detail.

10 Claims, 3 Drawing Figures

BREAKING UP OF CONCRETE SURFACE LAYERS OR THE LIKE

The present invention relates to the breaking up of concrete surface layers, masonry walls, or like planar constructions.

Hitherto the majority of machnes for breaking up concrete surface layers have relied on a percussive effect. Known machines of this type have been fitted with a hardened workpiece or tool and in operation this is struck rapidly against the concrete surface to break it away. Although reasonably satisfactory, such machines have two important drawbacks. The first of these is that they are very noisy in operation. Not only is this unpleasant for those operating the machine but it is also disturbing for those in the vicinity of the work area. In some instances of course, e.g. where the work is being carried out near a hospital or nursing home, a large noise factor is particularly undesirable. The second disadvantage is that each time the percussion tool strikes the concrete, shockwaves travel through the concrete from the part under treatment and these may damage nearby structures or vibration sensitive equipment or service pipes in the ground supporting the concrete under treatment.

It is an object of the present invention to provide a device for breaking concrete surface layers or the like in which the disadvantages outlined above are eliminated or reduced.

According to the present invention, an apparatus includes a body portion, first and second members for location on opposite sides of a concrete surface layer, masonry wall, or like planar construction, the free end of the first member being at, or movable to, a position which is at a greater distance from the body portion of the apparatus than the distance between the free end of the second member and the body portion of the apparatus, and an expansion device effective in operation of the apparatus to bring the first and second members into and out of gripping relationship with the construction to be gripped. In the first of these two conditions the free end of each member either engages the construction or carries a tool engaging the construction and the expression "gripping relationship" is to be interpreted both here and in the claims as including both these possibilities.

It should be understood that it is only by having the free end of the first member furthest from the free edges of the construction to be broken that the desired breaking stresses can be set up in the material during subsequent operation.

The first and/or second expansion device may, for example, be provided by mechanical and/or fluid power rams e.g. hydraulic or pneumatic rams.

Preferably means are also provided for moving the free end of the first member relative to the second member and towards or away from the body portion of the apparatus.

According to a preferred feature, where the apparatus is intended for use with a planar construction which is horizontally disposed, or approximately so, the second member is one of two foot members adapted to engage the under-surface of the construction at positions spaced apart from one another along a free edge of the construction, and the first member is disposed so as to lie on the other side of the construction at a position substantially equally spaced from each said foot members.

The invention also includes a system for use in breaking up concrete surface layers, masonry walls, or like planar constructions, comprising the apparatus of the present invention in combination with an excavator, or like supporting means.

Conveniently, when the apparatus includes a hydraulic ram as expansion device and the supporting means is at least in part hydraulically actuated, the operating fluid for the hydraulic ram is derived from the hydraulic system for the supporting means.

Embodiments of the invention will now be described by way of example with reference to the accompanying drawings of which:

Figure 1:
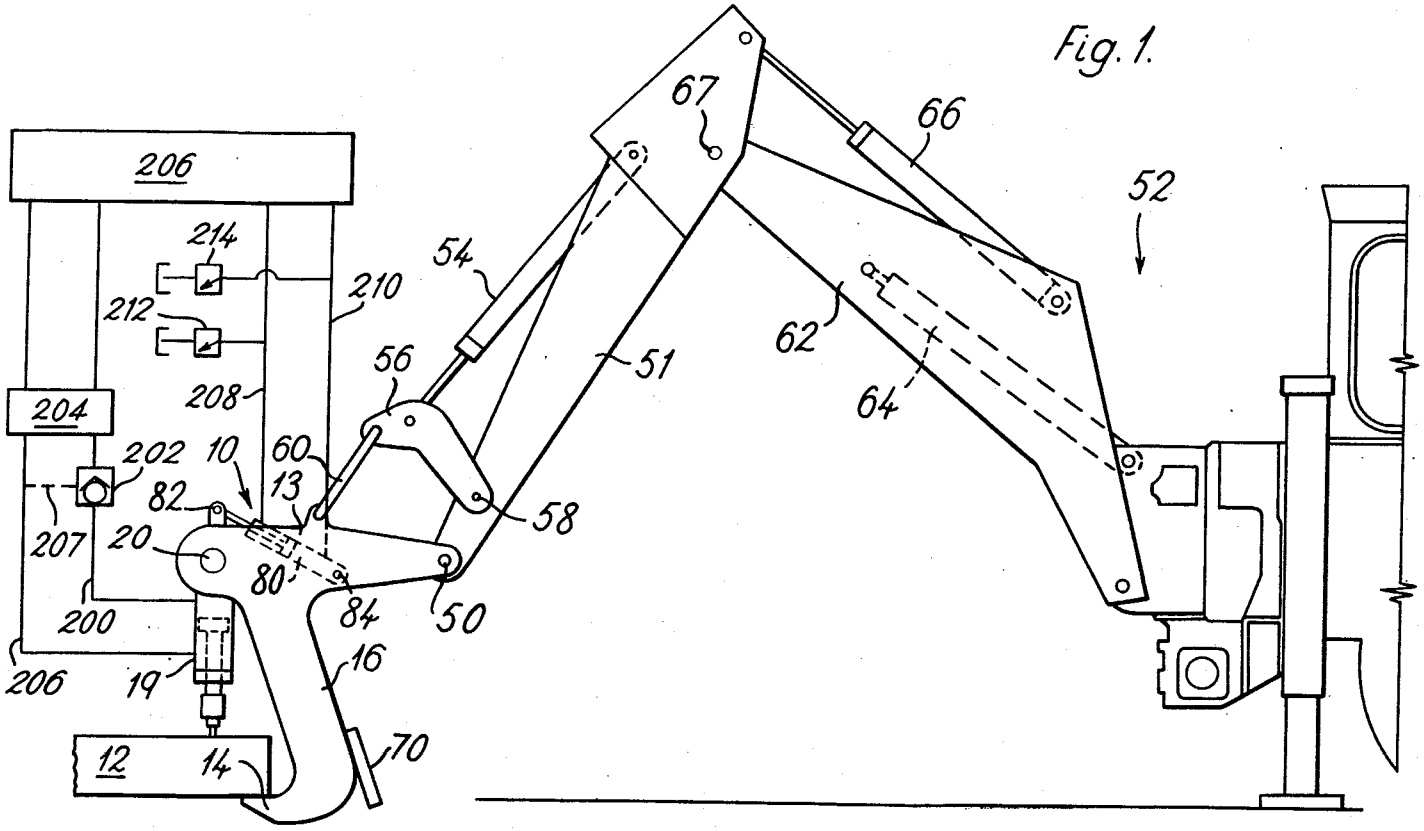
FIG. 1 shows a perspective view of a device in accordance with the present invention and supported by a conventional hydraulically operated excavator.
Figure 2:
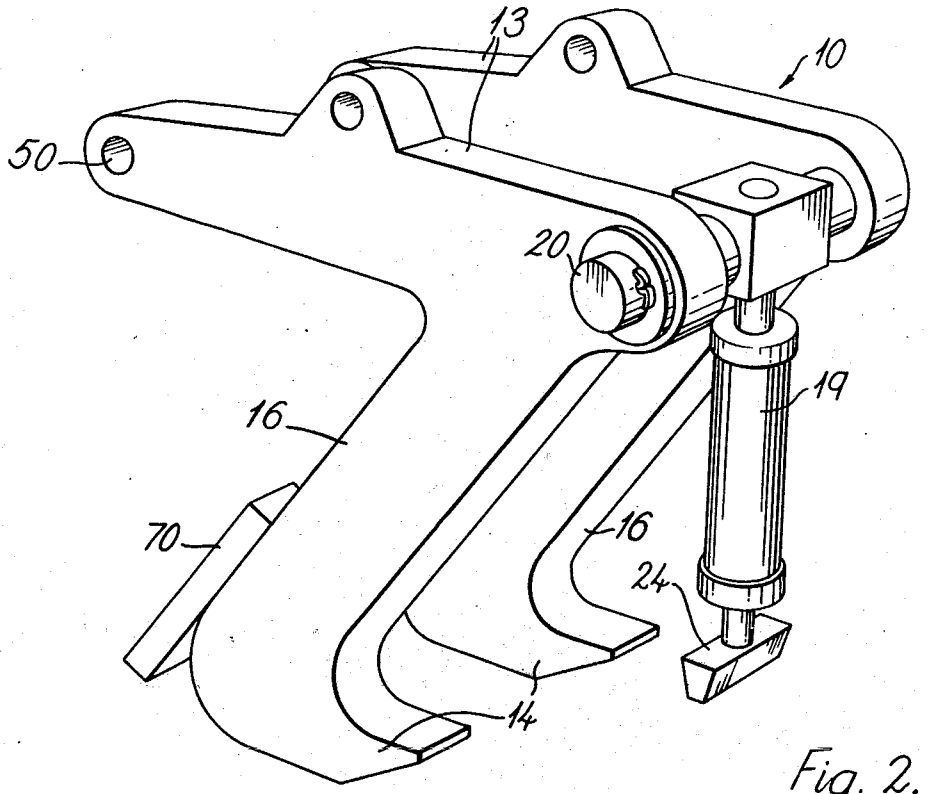
FIG. 2 shows the device of FIG. 1 on an enlarged scale.

Thus referring first to FIGS. 1 and 2 of the drawings, a device 10 for breaking pieces off a surface layer 12 of concrete comprises a body portion 13 and two foot members 14 carried at the lower ends of arms 16. In a modification (not shown), the distance between the two foot members can be adjusted. At their other ends the arms 16 are pivotally connected at 50 with the dipper arm 51 of a conventional excavator indicated generally by reference numeral 52. The orientation of the device is controlled by the excavator crowd cylinder 54 which rotates the excavator crowd 56 about a pivot connection 58 to exert a force in the link 60 between the excavator crowd and the device 10.

A double-acting hydraulically actuated ram 19 is pivotally connected at its upper end with arms 16 by an axle 20. Ports (not shown) allow operating fluid for the ram to be taken directly from the hydraulic control system for the excavator. In an alternative embodiment these ports are connected up with a suitable hydraulic line from a conventional pump.

At its lower end the ram piston member carries a tool piece 24 providing the "first member" of the device, the "second members" being of course provided by foot members 14.

A double-acting hydraulically actuated "adjustment" ram 80 is pivotally connected by pivots 82, 84 to the top end of ram 19 and to the body portion 13 of device 10. Expansion and retraction of ram 80 has the effect of pivotting ram 19 about axle 20 so as to alter the spacing of tool piece 24 from the body portion 13 of the device. In this way tool piece 24 is always at, or movable to, a position in which the spacing of the tool piece from body portion 13 is greater than the spacing of foot members 14 from body portion 13.

In one embodiment for breaking a ten inch layer of concrete 12 the ram will have a piston head area of sixteen square inches, the reduced pressure of the operating fluid in the ram 19 will be six thousand pounds per square inch, the distance of the foot members 14 from the pivot 50 will be 32 inches and the distance of the workpiece (in its upright position) from the pivot 50 will be 41 inches. This embodiment could be used for breaking thicknesses of up to 12 inches say but for greater thicknesses of concrete it would be necesssary to scale up the device accordingly.

In operation of the illustrated embodiment, the excavator is positioned in place and the device is lowered to ground level by appropriate movement of the excavator boom 62 (controlled by cylinder 64) and the dipper arm 51 (controlled by cylinder 66). Crowd cylinder 54 is now used to set the device at a suitable orientation and the dipper arm is swung (by cylinder 66) about its boom pivot 67 to swing feet 14 with sufficient momentum to force them under a border region of layer 12 without any prior excavation being necessary. All this time the ram 19 has been maintained contracted in line with the body portion 13 to keep tool 24 clear of the upper surface of layer 12. Now however, with the feet in place, ram 19 is rotated, using adjustment ram 80, to a position above the surface layer 12, say sixteen inches or so from the free edge of the concrete in the case under consideration, and then the ram is expanded so that the layer is gripped between tool 24 and feet 14. A bending moment is next applied to the border region of the layer by expanding the crowd cylinder 54 to break off a piece of concrete from layer 12. It is only because the tool piece 24 is further from body portion 13 than are feet 14 that a satisfactory bending moment could be applied. If for example, the tool piece and feet were directly opposite one another, then expansion of crowd cylinder 54 would produce a crushing action rather than a bending action.

If desired, the broken off piece can be gripped by resetting the device by retracting ram 19, rotating it using ram 80 about pivot 20 and re-applying the tool at some location nearer the foot members 24. Alternatively, drag bars 70 can be provided behind feet 14 so that when the concrete has been broken off in the way above described, the device can be passed over the broken off piece, lowered, and dragged back rearwardly to pull the piece of concrete sufficiently away from the remainder of the concrete to allow the device to be used on the nexly exposed edge.

The device need not necessarily be mounted on an excavator of course, for example a crane or fork-lift truck might be used instead. Adaption would probably only require additional hydraulic cylinders for actuation of the device the shape of which could remain substantially unchanged.

The broken-off pieces can be left adjacent the remainder of the layer or else removed (by appropriate manipulation of the excavator) to clear the way for the device to be brought up to either the new edge region or else up to an adjacent and as yet unbroken portion of the original border region of the surface layer.

In an alternative mode of operation, the bending moment is applied to the layer by continued expansion of ram 19 after its engagement with the upper face of the surface layer 12 until eventually a piece of concrete is broken off.

It is of course important that when the bending moment is applied to the concrete, the ram 19 shall not be collapsed since the device would then lose its grip on the concrete and could not operate satisfactorily. Accordingly the hydraulic line 200 to the top of the piston includes a pivot operated check valve 202.

Provided line 200 is acting as the pressure line, valve 202 prevents liquid from leaving the top of the ram cylinder and so locks the ram against unintentional collapse. However, when it is desired to retract ram 19 and line 206 becomes the pressure line, the check valve 202 is automatically opened by the pilot signal fed in via branch line 207 to allow an upward movement of the ram piston.

A four way valve 204 is provided to switch one or other line 200, 204 to the pressure side of the excavator hydraulics system 206 or to switch to a neutral position in which both lines will be isolated from the excavator hydraulics system.

In contrast to ram 19, ram 80 must be free to expand or retract in response to any side loads on ram 19 and hence each line 208, 210 to ram 80 includes a respective relief valve and tanking system (212, 214). The excavator hydraulics system will include an available four way valve (not shown) and this is used to control the flow of operating fluid to and from valve 80.

Figure 3:
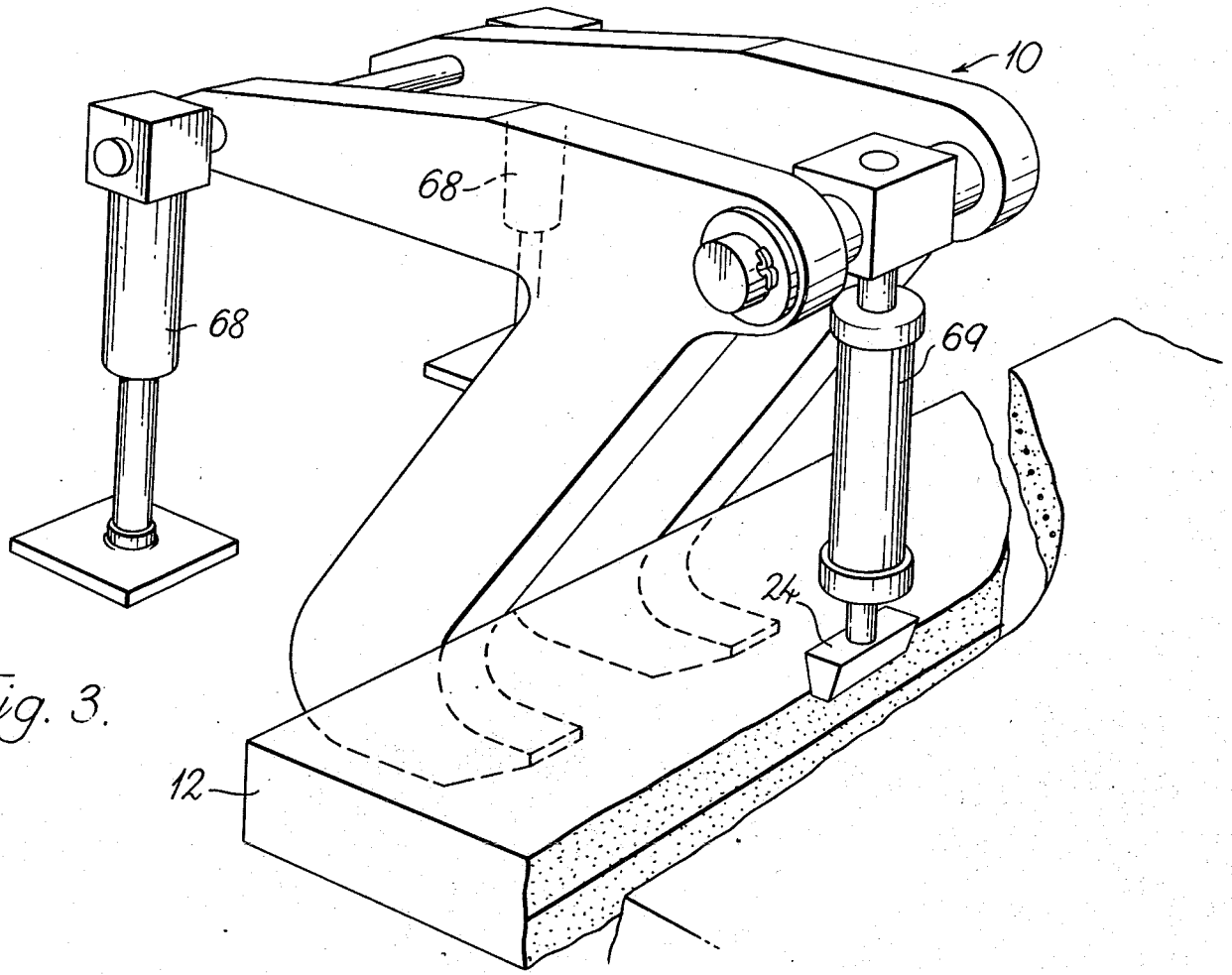
FIG. 3 shows an alternative embodiment to that shown in FIGS. 1 and 2.

FIG. 3 shows a freestanding version of the device in which the bending movement can be applied either by expansion of ram 69 or (after the tool has been brought into gripping relationship with the layer of concrete) by expansion of rams 68 in the two supports. It will be observed that the concrete has cracked underneath the tool piece 24. FIG. 3 also shows the 1/4 inch reinforcement mesh which will usually be present in concrete constructions of this type.

Although the drawings show apparatus for use on a horizontal block of material, it will be appreciated that it could equally well be used to break pieces off a vertically disposed wall of material e.g. a masonry wall, or an inclined construction.

We claim:

1. Apparatus for breaking a concrete surface masonry wall or like planar construction comprising a rigid member, said rigid member having a body portion adapted to be positioned adjacent a free edge of the construction, said rigid member having a gripping portion remote from said body portion for engaging one major face of said construction, gripping means for gripping the other major face of the construction at a greater distance from said body portion of said rigid member than the distance between said gripping portion and said body portion, said gripping means being pivotally mounted to said rigid member and expansion means for pivoting said rigid member to effect breaking of the construction.

2. An apparatus as claimed in claim 1 wherein the expansion means is provided by a ram device.

3. An apparatus as claimed in claim 1 including means for moving the said other gripping portion towards or away from said body portion.

4. An apparatus as claimed in claim 1 and for use when the planar construction is horizontally disposed, or approximately so, wherein the rigid member is one of two such members having gripping portions adapted to engage the undersurface of the construction at positions spaced apart from one another along the free edge of the construction, and said other gripping portion is disposed so as to lie on the other side of the construction at a position substantially equally spaced from each of the said gripping portions of said rigid members.

5. A system for use in breaking up concrete surface layers, masonry walls, or like planar construction, the system including an apparatus as claimed in claim 1 in combination with a crane, excavator, or fork-lift truck.

6. A system as claimed in claim 5 wherein the apparatus includes a hydraulic ram as the expansion means and the supporting means is at least in part hydraulically actuated, and the system includes duct means for transmission of operating fluid for said hydraulic ram to or from the hydraulic system for the supporting means.

7. For use in breaking a concrete surface layer, masonry wall or like planar construction, an apparatus comprising a rigid member, a body to said rigid member for location adjacent a free edge of the construction, a gripping portion to said rigid member remote from the body portion and for location adjacent one major face of said construction, another gripping portion remote from the body portion and for location adjacent the other major face of the construction, said other gripping portion being movable to a position that is at a greater distance from the body portion of the apparatus than the distance between the gripping portion of said rigid member and the body portion of the apparatus, an expansion means, and a pivotal connection connecting the expansion means to the remainder of the apparatus, said pivotal connection being fixed relative to said other gripping portion, actuation of the expansion means in operation of the apparatus being effective to urge said gripping portions closer together.

8. Apparatus for breaking concrete slabs or like planar constructions comprising:

a rigid member adapted to be positioned adjacent a free edge of said slab, said rigid member having a body portion and a first gripping member, first pivoting means for pivoting said rigid member, said first gripping member being remote from said body portion and adapted to be positioned in contact with one face of said slab, a second gripping member pivotally mounted to said rigid member remote from said body portion, second pivoting means for pivoting said second gripping member, said second gripping member further including expansion means for expanding and contracting the length of said second gripping means in contact with the opposite face of said slab, said first and said second gripping members being positioned with respect to each other such that when each of said first and second gripping members contacts opposite faces of said slab the distance between the point of contact on the face and the free edge of said slab, respectively, is unequal thereby causing a bending moment when said rigid member is pivoted.

9. Apparatus for breaking a concrete surface masonry wall or like planar construction comprising positioning means for adjustably positioning said apparatus, a rigid member pivotally attached to said positioning means, said rigid member having a body portion for location adjacent a free edge of the construction, said rigid member having a gripping portion remote from said body portion for engaging one major face of said construction, gripping means for gripping the other major face of the construction at a greater distance from said body portion of said rigid member than the distance between said gripping portion and said body portion, said gripping means being pivotally mounted to said rigid member and expansion means for pivoting said rigid member.

10. Apparatus for breaking concrete slabs or like planar constructions comprising:

a positioning means for adjustably positioning said apparatus, a rigid member pivotally mounted to said positioning means so as to be positionable adjacent a free edge of said slab by said positioning means, said rigid member having a body portion gripping member, first pivoting means for pivoting said rigid member, said first gripping member being remote from said body portion and adapted to be positioned in contact with one major face of said slab, gripping means pivotally mounted to said rigid member remote from said body portion, for gripping the other major face of the slab, second pivoting means for pivoting said gripping means, said gripping member and said gripping means being respectively positioned with respect to each other on the two major faces of the slab such that the distance between the point of contact of said gripping member and said gripping means on the major faces and the free edge thereof is unequal, thereby causing a bending moment when said rigid member is pivoted.

* * * * *